United States Patent [19]

Fitjer

[11] Patent Number: 4,961,665

[45] Date of Patent: Oct. 9, 1990

[54] MASCARA APPLICATOR

[76] Inventor: Holger Fitjer, Lambrechtstrasse 15, D-8800 Ansbach, Fed. Rep. of Germany

[21] Appl. No.: 389,707

[22] Filed: Aug. 4, 1989

[30] Foreign Application Priority Data

Aug. 18, 1988 [DE] Fed. Rep. of Germany ..... 8810416

[51] Int. Cl.[5] ..... A46B 11/00; A45D 34/04

[52] U.S. Cl. ..... 401/129; 401/118; 401/119; 401/121; 132/218; 15/159 R

[58] Field of Search ..... 401/118, 119, 129, 121, 401/127; 132/218, 216, 217; 15/106, 159 A, 159 R, 160, 206

[56] References Cited

U.S. PATENT DOCUMENTS

| | | | |
|---|---|---|---|
| 4,598,723 | 7/1986 | Cole | 132/218 |
| 4,671,689 | 6/1987 | Gueret | 132/218 |
| 4,705,053 | 11/1987 | Goncalves | 401/129 |

*Primary Examiner*—Robert A. Hafer
*Assistant Examiner*—Kerry Owens

[57] ABSTRACT

A mascara applicator comprises a mascara brush and a mascara container having an opening for insertion of the mascara brush into the container. The brush comprises a cap with an elongate fixing element to which the bristles of the mascara brush are secured, with the bristles extending in a helical configuration along the elongate fixing element. The bristles define first and second different brush diameters, with the large diameter defined by the bristles being larger than the diameter of the opening in the mascara container. The small diameter defined by the bristles is smaller than or at most equal to the diameter of the opening in the mascara container. The tips of the bristles define, along the length of the fixing element, first and second helically extending lines which are displaced at 180° relative to each other.

9 Claims, 1 Drawing Sheet d6
d4
d5
d7
d2
d1
d3
r1
r2
r4
r5
r7
a
b
l
10
12
14
16
18
20
22
24
26
28
30
32
34
36
38
40
42
44
46
48
50
52

MASCARA APPLICATOR

BACKGROUND OF THE INVENTION

In one form of a mascara applicator, as disclosed in German utility model No 87 12 015, the mascara applicator comprises a mascara brush which is formed by a fixing element and bristles which are carried on the fixing element and which extend in a helical configuration along the length thereof, with the bristles defining a single brush diameter. The brush further includes a cap portion having a stem which projects in the axial direction of the brush from the cap portion and to which the fixing element is secured. The stem is provided with a retaining projection which, when the brush is inserted into a container forming a further part of the mascara applicator, comes into retaining co-operation with at least one other retaining projection on the container.

In another form of mascara applicator, as disclosed in DE No. 35 05 969 A1, the applicator comprises a mascara brush including a cap member with a stem projecting thereon and an elongate fixing element which is connected to the stem. The fixing element carries bristles which are arranged in a plurality of rows, being of greater and smaller lengths respectively. The rows of longer and shorter bristles may extend in the axial direction of the brush in a linear configuration or in a helical configuration. In production of such a brush, after bristles of the same length throughout have been secured to the elongate fixing element, the brush with equal-length bristles is subjected to a processing operation using a tool which is operable to reduce the length of specific bristles, whereby the bristles define two different diameters on the brush, with the larger diameter of the bristles being larger than the diameter of the opening of a mascara container into which the mascara brush is inserted. It will be appreciated that that manner of manufacture involves a not inconsiderable level of expenditure. Furthermore, while a mascara applicator of that kind provides good application of mascara and at the same time gives a good combing effect, after the mascara applicator has been used for a number of times, it is not possible to prevent the opening of the mascara container or the stem on the mascara brush becoming contaminated with mascara.

SUMMARY OF THE INVENTION

An object of the present invention is to provide a mascara applicator which does not suffer from disadvantages of the previous applicators.

Another object of the present invention is to provide a mascara applicator which can provide for the uniform application of mascara and which can also produce a satisfactory combing effect in the application of mascara.

Still another object of the present invention is to provide a mascara applicator comprising a mascara brush with a projecting stem carrying a bristle-fixing element and a container for accommodating the brush, wherein the opening of the container and the stem of the brush do not become contaminated with mascara.

In accordance with the invention, these and other objects are achieved by a mascara applicator including a mascara brush and a container for containing mascara. The container has an opening for insertion of the mascara brush thereinto. The mascara brush has a stem portion and an elongate fixing element which is connected to the stem portion, with a plurality of bristles arranged on the elongate fixing element in a helical configuration, with the bristles defining first and second brush diameters, wherein the large diameter of the bristles is larger than the diameter of the opening of the mascara container into which the brush is inserted. The tips of the bristles form first and second helical lines which are displaced through 180° of angle relative to each other. The smaller diameter of the bristles of the mascara brush is smaller than or at most equal to the diameter of the opening of the mascara container.

By virtue of the mascara brush comprising bristles, the tips of which form around the elongate fixing element first and second helically extending lines which are displaced relative to each other through 180°, when the mascara brush is withdrawn from the container, with a twisting movement of the brush relative to the container, the inside wall surface of the opening of the container is subjected to a cleaning action by the long bristles which therefore form the larger diameter of the mascara brush. At the same time, by virtue of the large diameter being larger than the diameter of the opening in the mascara container, mascara is removed from the long bristles in the course of the relative movement as between the container and the mascara brush. The longer bristles which thus define the larger diameter of the brush serve in particular to produce a combing effect on the eyelashes in the application of mascara. On the other hand, as the shorter bristles which are displaced through 180° with respect to the longer bristles and which define the smaller brush diameter are shorter than half the diameter of the opening in the mascara container, those shorter bristles do not come into contact with their tips against the inside wall surface of the opening in the mascara container so that mascara is not removed from the shorter bristles as the brush is moved relative to the container. The short bristles therefore serve as a means for storing mascara for application to the eyelashes.

In a preferred feature of the mascara applicator according to the invention, the large and small diameters defined by the bristles of the mascara brush are arranged in mutually concentric relationship in projection along the longitudinal direction of the fixing element, with the fixing element being disposed at the center of the first and second diameters.

In accordance with another preferred feature of the invention, the mascara applicator may provide that the bristles, in projection along the longitudinal direction of the fixing element, form a basic shape of kidney-like configuration, the smallest radial extent of which is greater than or equal to half the smaller diameter defined by the bristles of the brush while the largest radial extent of the kidney-like configuration is equal to or smaller than half the larger diameter defined by the bristles of the brush. That means that the mascara brush is of an asymmetrical configuration whereby the combing effect thereof can be improved, without the aspect of storage of mascara on the bristles of the brush or the uniform application of mascara to eyelashes being adversely affected as a result.

In another preferred feature of the invention, the stem portion of the mascara brush may comprise at least one retaining means such as a retaining projection and the mascara container may comprise at least one co-operating retaining means such as a further retaining projection into which the retaining projection on the stem portion of the mascara brush engages in the closed position of the applicator. Such a configuration of the mascara applicator with the mutually cooperating retaining means is advantageous when using a mascara brush in which the two brush diameters, of a helical configuration, are disposed concentrically around the fixing element for the bristles, but a mascara applicator with retaining projection on the stem portion and co-operating retaining projection on the mascara container is used to particular advantage when the bristles of the mascara brush, in projection along the longitudinal direction of the fixing element, form a basic shape of asymmetrical and preferably kidney-like configuration because in that case the mutually co-operating retaining projections provide an orientation effect in relation to the kidney-like shape of the brush.

Further objects, features and advantages of the present invention will be apparent from the following description of preferred embodiments of the mascara applicator.

DESCRIPTION OF PREFERRED EMBODIMENTS

Figures 1, 2, 3, 4, 5, 6, 7:
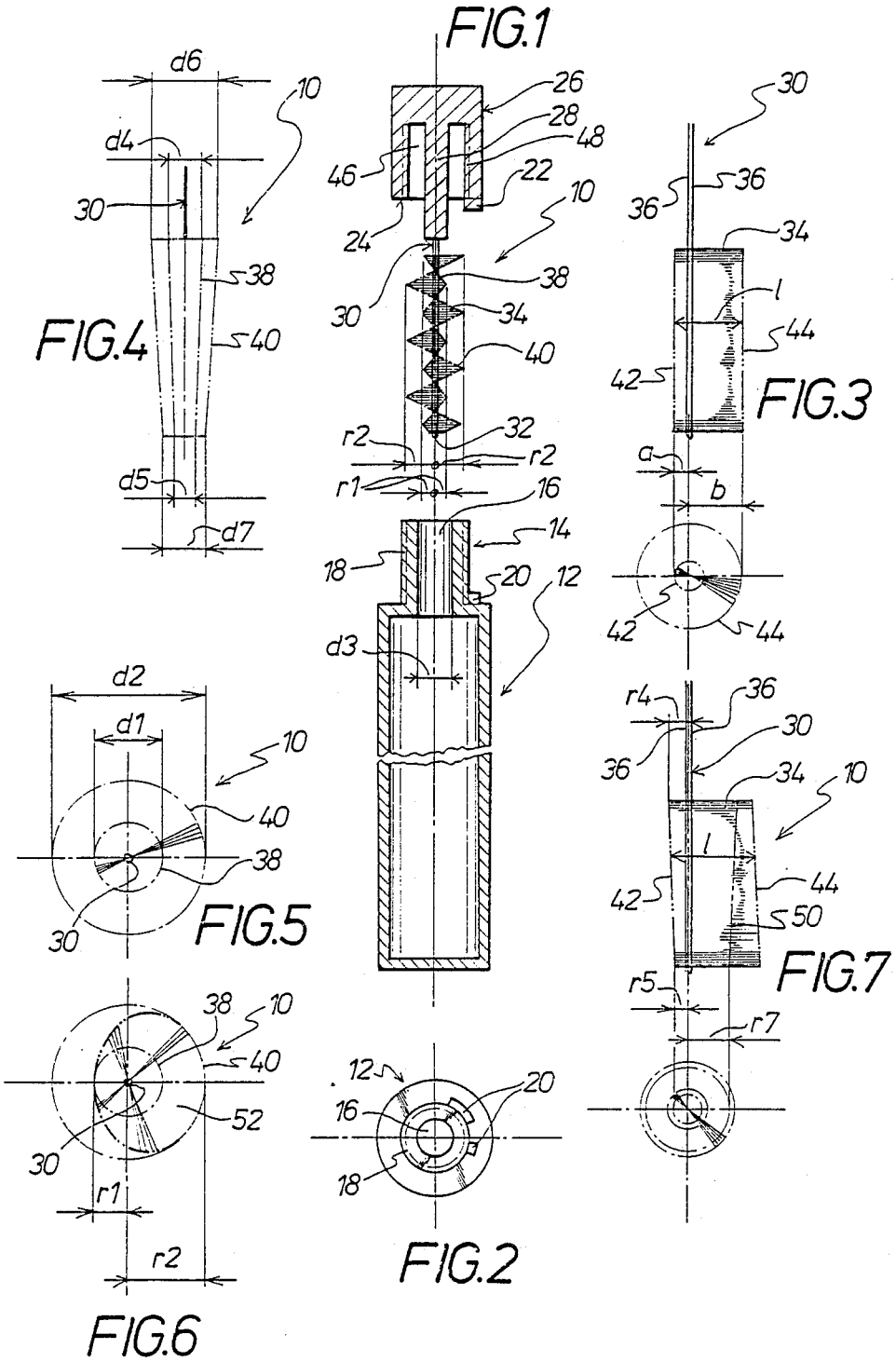
FIG. 1 is a view in longitudinal section through a mascara applicator according to the invention, with the mascara brush being shown at a spacing from the diagrammatically illustrated mascara container.
FIG. 2 is a plan view of the mascara container shown in FIG. 1.
FIG. 3 shows a side view and a plan view of a fixing element and the bristles of a mascara brush.
FIG. 4 is a diagrammatic side view of a second embodiment of the mascara brush.
FIG. 5 is a view of a mascara brush from above.
FIG. 6 is a view of another embodiment of the mascara brush from above.
FIG. 7 shows a front view and a plan view of a fixing element and bristles for the production of a mascara brush as diagrammatically illustrated in FIG. 4.

Referring firstly to FIG. 1, shown therein is a mascara applicator comprising a mascara brush indicated generally at 10 and a mascara container indicated generally at 12. The mascara container 12 comprises a body portion for accommodating the mascara and a reduced-diameter neck portion 14 having an opening 16 and carrying an external screwthread 18. As can be seen from FIG. 2, the mascara container 12 is further provided with a retaining projection configuration 20 comprising first and second bumps or knobs which are disposed at a small spacing from each other. The mascara applicator in turn comprises a retaining projection indicated at 22 which, in the closed position of the mascara applicator in which the brush is inserted into the container 12 through the opening 16 thereof, co-operates with the retaining projection configuration 20 on the container. It will be seen from FIG. 1 that the retaining projection 22 is disposed at the end face 24, which faces downwardly in FIG. 1, of a closure cap 26.

The mascara brush further comprises a stem portion 28 which is integrally connected to the closure cap 26 and to which an elongate fixing element 30 is in turn fixed. The fixing element 30 comprises for example two wire portions which are connected together at the front or tip end 32 of the fixing element 30 and between which bristle 34 are disclosed. In manufacture of the brush, the two wire portions which are connected together at the front end 32 of the brush receive the bristles 34 which are suitably inserted between them, and then the two wire portions are twisted relative to each other to hold the bristles 34 firmly in position therebetween.

Reference will now be made to FIG. 3 showing the way in which the bristles 34 are arranged in an eccentric relationship with the fixing element 30, between the two wire portions which are indicated at 36 in FIG. 3, for forming the fixing element 30. After the two wire portions 36 are twisted together, that arrangement provides a brush configuration defined by first and second helically extending lines as indicated at 38 and 40 in FIG. 1, along which the tips 42 and 44 respectively of the bristles 34 extend around the fixing element 30. As shown in FIG. 3, the spacing of the tips 42 of the bristles from the fixing element 30 is indicated by a while the spacing of the tips 44 of the bristles from the fixing element 30 is indicated by b. The length of the bristles 34 is indicated at 1 in FIG. 3, wherein $1=a+b$. The radius r1 of the inner helically extending line 38, as shown in FIG. 1, corresponds to the spacing a while the larger radius shown at r2 in FIG. 1 in respect of the helically extending line 40 of larger diameter, corresponds to the spacing b. The two helically extending lines 38 and 40 extend in the same direction, with the tips 42 and 44 of the bristles 34, which define the respective lines 38 and 40, being disposed in diametrically opposite relationship at 180° of angle relative to each other.

It will be seen from FIG. 1 that the opening 16 of the mascara container 12 is of a diameter indicated at d3 which is smaller than double the larger radius indicated at r2 of the helically extending line 40 in FIG. 1. The smaller diameter of the brush, which can be identified as d1, corresponding therefore to double the smaller radius r1 in respect of the helically extending line 38, is smaller than or at most equal to the diameter d3 of the opening 16 of the mascara container 12.

Referring still to FIG. 1, the closure cap 26 of the mascara brush 10 has a recess 46 formed therein, which is provided with an internal screwthread as indicated diagrammatically at 48. The external screwthread 18 on the neck portion 14 of the mascara container 12 and the internal screwthread 48 on the closure cap 26 of the mascara brush 10 correspond to each other so that the closure cap 26 can be sealingly screwed on to the mascara container 12.

Reference will now be made to FIG. 4 showing a diagrammatic side view of a mascara brush 10 in which the first and second helically extending lines 38 and 40 do not form a cylindrical contour each of a respective constant diameter d1 (corresponding to 2.r1) and d2 (corresponding to 2.r2) respectively, as in the case of the embodiment shown in FIGS. 1 through 3, but instead are of a frustoconically tapering contour. The contour of the helically extending line 38 decreases from a diameter indicated at d4 in FIG. 4 to a small diameter indicated at d5, while the contour of the helically extending line 40 decreases from a diameter indicated at d6 to a diameter indicated at d4. Reference numeral 30 is also used in FIG. 4 to identify the diagrammatically illustrated fixing element to which the bristles of the mascara brush are secured. The mascara brush 10 can be of such a design configuration by virtue of the fact that, as can be seen from FIG. 7, bristles 34 of a constant length 1 are not arranged between the two portions of wire 36 forming the fixing element 30, with the outline contours defined by the bristle tips 42 and 44 extending parallel to the axis of the fixing element 30 in the manner shown in FIG. 3, but rather the bristles 34 of constant length 1 are arranged with a progressive lateral offset a viewed over the longitudinal direction of the fixing element 30. The lateral offset of the tips 42 of the bristles 34, which define the smaller diameter of the brush, is indicated at r4 and r5 in FIG. 7, wherein 2.r4 as shown in FIG. 7 is equal to the dimension d4 shown in FIG. 4, and 2.r5 in FIG. 7 is equal to the dimension indicated at d5 in FIG. 4. FIG. 7 also includes a broken line 50 along which the mascara brush 10 is subjected to a cutting operation using a suitable cutting device, after the first and second wire portions 36 forming the fixing element 30 have been twisted together, the purpose of the cutting operation being to produce the helically extending line 40 of frustoconical configuration as indicated in FIG. 4.

FIG. 5 is a plan view on an enlarged scale of a mascara brush in which the fixing element 30 is disposed at the center of the helically extending lines 38 and 40 which extend in mutually coaxial relationship. The small diameter defined by the helically extending line 38 is indicated by d1 while the diameter of the helically extending line 40, which is large in relation to the diameter defined by the helically extending line 38, is indicated by d2. The diameter d1 is equal to 2.r1 in FIG. 1 and the diameter d2 in FIG. 5 is equal to 2.r2 in FIG. 1.

Referring now to FIG. 6, while FIG. 5 shows a mascara brush 10 of a symmetrical configuration, FIG. 6 is a corresponding plan view but of a mascara brush 10 in which, after the wire portions forming the fixing element 30 have twisted together, the bristles are subjected to cutting in such a way as to provide a basic shape 52 of the mascara brush 10, of a substantially kidney-like configuration. In FIG. 6 r1 is half the small diameter d1 defined by the helically extending line 38 while r2 denotes half the diameter d2 defined by the helically extending line 40.

Although not shown in FIG. 1, the mascara container 12 has a per se known wiper or scraper portion therein which defines the diameter d3 of the opening 16 of the mascara container 12. In the closed condition of the mascara applicator the wiper or scraper portion bears snugly against the stem portion 28 on the closure cap 26 so that the container is then suitably sealed closed to prevent the mascara material in the container 12 from drying out.

It will be appreciated that the above-described embodiments of the mascara applicator according to the principles of the present invention have been described solely by way of example and illustration of the invention and that various modifications and alterations may be made therein without thereby departing from the spirit and scope of the invention.

I claim:

1. A mascara applicator including: a mascara brush comprising a stem portion, an elongate fixing element connected to the stem portion, and bristles which are carried on the fixing element and which extend along the fixing element with the bristle tips forming first and second helical lines which are displaced through 180° of angle relative to each other, the tips of the bristles along said first helical line defining a first brush diameter and the tips of the bristles along said second helical line forming a second brush diameter which is smaller than the first brush diameter; and a container for mascara, having an opening for insertion of the mascara brush into the container, wherein the first brush diameter defined by bristles of the mascara brush is larger than the diameter of the opening of the mascara container and the second brush diameter defined by bristles of the mascara brush is at most equal to the diameter of the opening of the mascara container.

2. A mascara applicator as set forth in claim 1 wherein said second brush diameter is smaller than said diameter of the opening of the mascara container.

3. A mascara applicator as set forth in claim 1 wherein the first and second brush diameters are arranged in mutually concentric relationship in projection along the longitudinal direction of the fixing element, with the fixing element being disposed at the center of the first and second diameters.

4. A mascara applicator as set forth in claim 1 wherein the bristles in projection along the longitudinal direction of the fixing element define a basic shape of kidney-like configuration, the smallest radial extent of the kidney shape being at least equal to half the second brush diameter and the largest radial extent of the kidney shape being at most equal to half the first brush diameter.

5. A mascara applicator as set forth in claim 4 wherein the smallest radial extent of the kidney shape is larger than half the second brush diameter.

6. A mascara applicator as set forth in claim 4 wherein the largest radial extent of said kidney shape is smaller than half the first brush diameter.

7. A mascara applicator as set forth in claim 1 wherein said mascara brush comprises first retaining means and the mascara container comprises second retaining means, the first and second retaining means co-operating with each other when the mascara brush is inserted into the mascara container in the closed condition of the mascara applicator.

8. A mascara applicator as set forth in claim 7 wherein said first retaining means comprises at least one retaining projection on the mascara brush and wherein said second retaining means comprise at least one further retaining projection on the mascara container.

9. A mascara applicator as set forth in claim 1 wherein said fixing element comprises first and second wire portions which are twisted together around each other with the bristles disposed fixedly in position between the first and second wire portions.

* * * * *